United States Patent [19]

Legler

[11] 4,218,858

[45] Aug. 26, 1980

[54] TRI-ANCHOR BRACKET FOR POLES

[75] Inventor: Steve Legler, Montreal, Canada

[73] Assignee: Tri-Steel Fabricators Ltd., Montreal, Canada

[21] Appl. No.: 968,737

[22] Filed: Dec. 13, 1978

Related U.S. Application Data

[63] Continuation of Ser. No. 814,138, Jul. 8, 1977, abandoned.

[51] Int. Cl.[2] ..... E02D 5/74; E04C 3/30

[52] U.S. Cl. ..... 52/165; 52/298; 52/704; 52/726

[58] Field of Search ..... 52/295, 298, 726, 704, 52/165, 155

[56] References Cited

U.S. PATENT DOCUMENTS

| | | | |
|---|---|---|---|
| 1,116,208 | 11/1914 | Barber | 52/295 |
| 1,745,572 | 2/1930 | Gray et al. | 166/217 |
| 1,984,753 | 12/1934 | Moss | 52/295 |
| 2,554,887 | 5/1951 | Tricarico | 248/531 |
| 3,017,799 | 1/1962 | Lemoine | 61/45 B |
| 3,139,730 | 7/1964 | Williams et al. | 61/45 B |
| 3,342,444 | 9/1967 | Nelson | 248/530 |
| 3,514,911 | 6/1970 | Preradovich | 52/726 |
| 3,556,217 | 1/1971 | Anastasia et al. | 166/217 |
| 3,837,258 | 9/1974 | Williams | 61/45 B |
| 3,967,455 | 7/1976 | Conway | 61/45 B |

FOREIGN PATENT DOCUMENTS

| | | | |
|---|---|---|---|
| 269316 | 6/1950 | Switzerland | 248/156 |
| 660979 | 11/1951 | United Kingdom | 52/161 |

*Primary Examiner*—James L. Ridgill, Jr.

*Attorney, Agent, or Firm*—Guy J. Houle; Alan Swabey; Robert Mitchell

[57] ABSTRACT

An anchor bracket for securing an article on a support surface. The anchor bracket comprises a clamp device for securement to the article and at least two anchor rods for anchoring in hard ground such as rock. Each of the anchor rods has a top end and a bottom end section with the bottom end section having an expanding end. A securement sleeve is provided about the bottom end section of each anchor rod and has at least an expandable section whereby the expandable section of the securement sleeve will be caused to expand by relative axial displacement with the expanding end of the anchor rod for anchoring the bottom end section in a hole of proper cross-section extending through the surface. The clamp device is attachable to the anchor rods for securement of the article on the support surface.

8 Claims, 4 Drawing Figures

TRI-ANCHOR BRACKET FOR POLES

This is a continuation of application Ser. No. 814,138 filed July 8, 1977 now abandoned.

BACKGROUND OF THE INVENTION (a) Field of the Invention

The present invention relates to an improved anchor bracket construction for securing articles on a hard support surface and more particularly, but not exclusively, for securement of line poles on rocky or similar hard surfaces.

(b) Description of Prior Art

Anchor brackets of this type are known, for example, as taught by Canadian Pat. No. 827,522, and utilized for securing poles above a hard surface, i.e., rock, concrete, etc. Often such brackets are used for securing telephone poles, which poles are subject to lateral bending loads caused by wind. These lateral loads are transferred to the anchoring point of the pole via the anchor bolts and apply axial pulling force on some of the bolts. When the bolts are frequently subjected to this pulling force, the anchor point will chew away at the side walls of the holes in which the bolts are secured and eventually the bolt can become very loose, causing the pole to bend and break its attachment to the bracket.

SUMMARY OF THE INVENTION

It is a feature of the present invention to provide an improved anchor bracket which substantially overcomes the above-mentioned disadvantage, which requires few parts, and which can be easily installed.

According to the above feature, from a broad aspect, the present invention provides an anchor bracket for securing an article on a support surface. The anchor bracket comprises a clamp device for securement to the article and at least two anchor rods. Each of the anchor rods has a top end and a bottom end section with the bottom end section having an expanding end. A securement sleeve is provided about the bottom end section of each anchor rod and has at least an expandable section whereby the expandable section of the securement sleeve will be caused to expand by relative axial displacement with the expanding end of the anchor rod for anchoring the bottom end section in a hole of proper cross-section extending through the surface. Means is provided to attach the clamp device to the anchor rods for securement of the article on the support surface.

BRIEF DESCRIPTION OF THE DRAWINGS

A preferred embodiment of the present invention will now be described with reference to the accompanying drawings in which.

DESCRIPTION OF THE PREFERRED EMBODIMENTS

Figure 1:
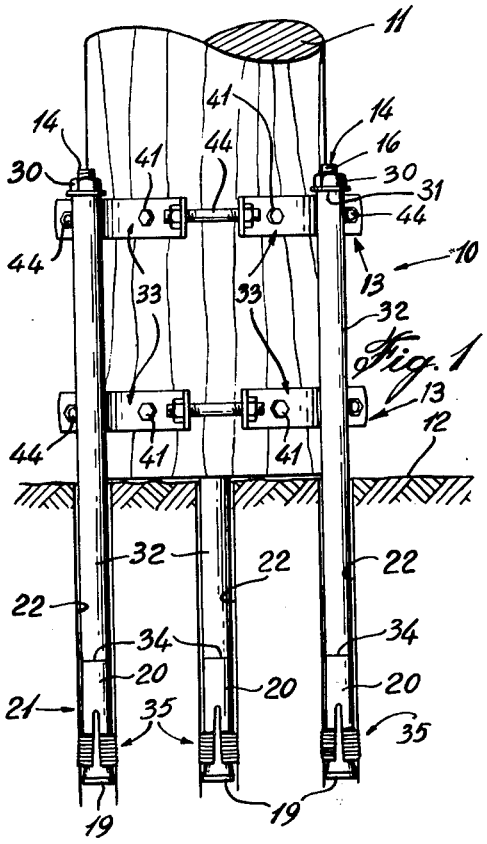
FIG. 1 is a side view, partly sectioned, of the anchor bracket of the present invention secured to a pole.

Referring now to the drawings, there is shown generally at 10, the anchor bracket of the present invention for securing an article 11, such as a hydro pole, telephone pole or the like, on a hard support surface 12, such as rock or concrete. The bracket 10 comprises essentially a clamp device 13 which is securable to the article 11 and at least two anchor rods 14, three being shown herein, cooperating with the clamp device.

Figure 3:
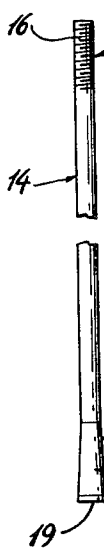
FIG. 3 is a fragmented view of an anchor rod.

Referring to FIG. 3, it can be seen that each of the anchor rods 14 has a top end section 15 having a threaded section 16 therealong. The bottom end section 17 of the rod is provided with expanding end 18 constituted by an enlargement defining a downwardly extending outward sloping enlargement. The outward sloping enlargement 18 is conical in shape and extends to the bottom end 19 of the rod.

Referring again to the other drawings, a securement sleeve 20 is positioned about the bottom end section of each rod and has at least an expandable section whereby the securement sleeve will be caused to expand outwardly by relative axial displacement between the securement sleeve 20 and the expanding end 18 of the bolt 14 whereby to anchor the bottom end section 17 in a respective hole 22 disposed in the rock substantially transverse to the surface 12. The hole 22 could be disposed at an angle depending on the nature of the article being secured, i.e. angular support columns for structures.

Figure 4:
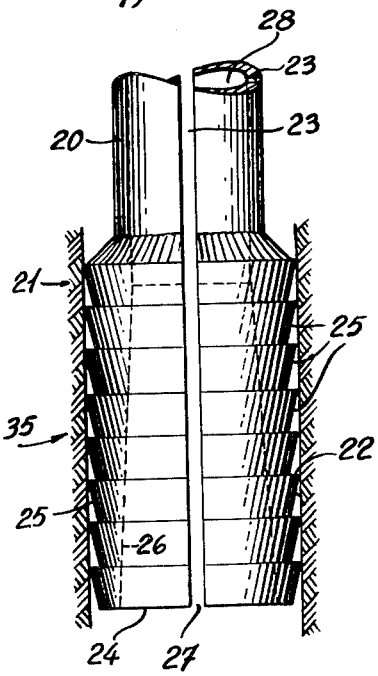
FIG. 4 is an enlarged end view of the bottom end portion of a securement sleeve.

As shown more clearly in FIG. 4, the securement sleeve 20 is provided with at least two spaced-apart slots 23, hereinshown four slots diametrically opposed, and extending from the bottom end 24 thereof along the bottom end portion 21 whereby to permit this portion to flare outwardly due to the relative axial displacement between the securement sleeve 20 and the expanding end 18 of the bolt 14. This outward flaring is caused by the outward pressure applied by the conical taper 18. Also, the bottom expandable section 21 may include a plurality of outer peripheral annular gripping ridges 25 to frictionally grip the side wall of the hole 22. Further, the bottom expandable section 21 of the securement sleeve 20 is hereinshown as being of greater thickness than the remaining portion of the sleeve 20 and having a tapered inner wall 26 to provide a bottom end opening 27 of larger diameter than the inner diameter of the remaining portion, such as shown at 28.

The relative displacement between the securement sleeves 20 and their respective anchor rods 14 is provided by gripping means which is displaceably engageable with the rods 14. In the embodiment disclosed herein, the gripping means is constituted by the nut 30 and a top securement sleeve member 32. The nut 30 is in threaded engagement with the threaded section 16 of the rod and abuts against the top end 31 of a top securement sleeve member 32 which is shown secured to a pair of spaced apart clamp flanges 33. The top securement sleeve is of sufficient length to abut against the top end 34 of the securement sleeve 20 with its top end 31 terminating along the threaded section 16. Thus, by threading the bolt 30, the anchor rod 14 will be caused to move upwardly through the top securement sleeve 32 and the securement sleeve 20 which is arrested, and the conically tapered end 18 will cause the expandable section 35 to flare outwardly and grip the surrounding side wall of its respective hole 22. A washer 36 may be interposed between the top end 31 of the sleeve 32 and the nut 30 not to damage the top end.

Figure 2:
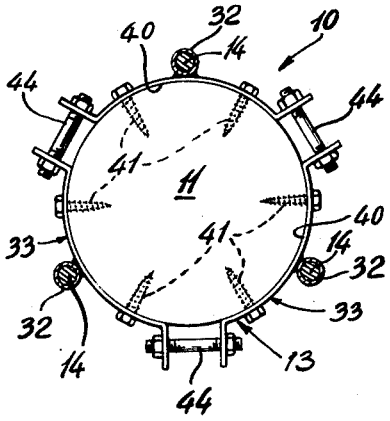
FIG. 2 is a plan view of the anchor bracket of the present invention.

The clamp flanges are of an arcuate formed section 40 to grip the post 11 and are provided with holes therein whereby screw bolts 41 can be inserted therethrough and into the post 11 to constitute a restraining means to secure the flange to the post after the anchoring of the bolts is effected. Also, the free ends 42 of the flanges 33 are flared outwardly to accommodate securement of an interconnecting bolt 44 whereby a plurality of flanges 33 may be interconnected about the post 11 to form the clamp device 13. As shown in FIG. 2, there are three such flanges about the post 11.

Although in the preferred embodiment herein disclosed there is shown a top securement sleeve having spaced-apart flanges 33, the clamp device could be constituted by one or more clamp flanges 33 having means other than the sleeve 32 to secure to the anchor rod 14. The relative movement between the anchor rod 14 and the securement sleeve 20 would then be provided by other means. Such other means, for example, could be constituted by having a threaded section of the bolt immediately above the top end 34 of the securement sleeve 20 whereby a ratchet having a threaded inner face would engage such thread and abut against the top end 34 of the securement sleeve to cause the axial relative displacement whereby to anchor the rods 14. Other means may also be provided to maintain the securement sleeve 20 stationary and to pull to rod 14 axially therethrough. Further, the top sleeve member 32 could be positioned about the rod 14 to effect relative movement only whereby to anchor the bolt 14 and then remove whereby clamps could be secured directly to the bolt. Thus, the installation would not include the top sleeve member 32. Also, the clamp flange can be constructed differently to secure objects of different shapes above the support surface 12. Similarly, the attachment of the anchor rods 14 to the article being supported or clamp flanges 33 may be done in many different ways, obvious to a person skilled in the art.

The expanding end 18 of the bolt 14 may also be formed differently. For example, the rod 14 may be of uniform cross section throughout and slitted at the bottom end 19 along section 17 diametrically in a crosswise manner. A wedge member (not shown) could be positioned in a slot at the bottom end 19 and resting on the bottom of the hole 22. By imparting axial blows on the top end of the rod 14, the wedge would cause the bolt bottom end section 17 to flare out as well causing the expandable section 35 to flare out whereby to anchor in the hole 22. The top end of the bolt could be provided in an extension (not shown) of smaller diameter than the threads 16 whereby to impart blows to the rod 14 without damage of the threads 16.

By the provision of a securement sleeve 20 extending through or in a portion of the bottom of the hole 22, it can be seen that when an axial load is applied to the bolt 14, that any force tending to cause axial displacement of the rod 14 will cause further lateral pressure to be applied against the expandable section 35 at the bottom end portion 21 of the securement sleeve 20. Thus, a pulling force on the bolt 14 will cause the anchor to become even more rigid. With the embodiment as shown in FIG. 1, when the pole 11 is subjected to lateral loads, such load will be transferred to some of the rods 14 and not to the securement sleeve 20. Thus, there is no axial pressure applied to the securement sleeve 20 which would result in a reverse effect of loosening the anchor rather than tightening it.

It is within the ambit of the present invention to cover any other obvious modifications of the embodiment of the present invention described herein provided such modifications fall within the scope of the broad claim.

I claim:

1. An anchor bracket securing a pole vertically on a hard rock-like support surface, said bracket comprising a clamp device secured to said pole, at least two anchor rods, each said anchor rod having a top end and a bottom end section, said bottom end section having an expanding end, a bottom securement sleeve about said bottom end section of each anchor rod and having at least an expandable section formed in a bottom end portion thereof, a top securement sleeve about each anchor rod above said bottom securement sleeve, said clamp device being fixedly secured to said top securement sleeve, a hole in said support surface receiving a respective one of said anchor rods and its associated bottom and top securement sleeves with said top securement sleeve extending out of said hole above said support surface, gripping means displaceably engaged with said rod top end section remote from said rod bottom end section and engageable with said top securement sleeve to cause axial displacement of said rod relative to said top securement sleeve and said clamp device, said top securement sleeve having a bottom end in abutment with a top end of said bottom securement sleeve permitting relative axial displacement between said expanding end of said anchor rod and said expandable section of said bottom securement sleeve when said rod is axially displaced by said gripping means whereby said expandable section is displaced outwardly by lateral pressure of said expandable section to anchor said bottom end section in its respective hole in said support surface, the fixed relation between said top securement sleeve, said clamp device and said post on the one hand and the relative movability of said rod and said bottom securement sleeve on the other hand permitting said rod when subjected to an axial pulling force caused by a transverse load applied to said pole to cause said rod expanding end to apply further lateral pressure to said expandable section of said bottom securement sleeve to increase said lateral pressure of said expandable section in the respective hole while said top securement sleeve is subjected to substantially no pulling force, and said top securement sleeve being retrained against lateral movement in a respective hole and restraining said post against lateral movement on said support surface.

2. An anchor bracket as claimed in claim 1 wherein said rod has a threaded section above said top securement sleeve and protruding above said support surface, said gripping means being a threaded member in threaded engagement with said threaded section.

3. An anchor bracket as claimed in claim 2 wherein said threaded section extends from said top end of said anchor rod, said clamp device including at least one clamp flange secured to said top securement sleeve, said top securement sleeve terminating at a top end along said threaded section, said threaded member being a nut causing said relative displacement of said anchor rod and said top securement sleeve when abutting with said top end of said top securement sleeve when turned about said threaded section.

4. An anchor bracket as claimed in claim 3 wherein said clamp flange has interconnectable ends for securement to one or more of said clamp flanges, and restraining means securing said flange to said post.

5. An anchor bracket as claimed in claim 1 wherein there are three of said anchor rods.

6. An anchor bracket as claimed in claim 5 wherein said expanding end is constituted by at least a portion of said bottom end section being enlarged to define a downwardly sloping outward enlargement.

7. An anchor bracket as claimed in claim 6 wherein said bottom securement sleeve is provided with at least two spaced apart slots in a bottom end portion thereof to permit said bottom end portion to be flared outwardly by said outward enlargement of said bolt during said relative displacement.

8. An anchor bracket as claimed in claim 7 wherein said bottom end portion is of greater thickness than the remaining portion of said securement sleeve, said bottom end portion having a tapered inner wall to provide a bottom end opening of larger diameter than the inner diameter of said remaining portion whereby to facilitate expansion of said expandable section.

* * * * *